US010807229B1

(12) United States Patent
Chiao et al.

(10) Patent No.: US 10,807,229 B1
(45) Date of Patent: Oct. 20, 2020

(54) WORKBENCH WITH COLLAPSIBLE PEGBOARD

(71) Applicant: Trinity International Industries, L.L.C., Carson, CA (US)

(72) Inventors: Jerry Chiao, Newark, CA (US); Yuan-Luen Chuang, Shanghai (CN); Cze-Chao Tam, Palos Verdes, CA (US)

(73) Assignee: Trinity International Industries, L.L.C., Carson, CA (US)

( * ) Notice: Subject to any disclaimer, the term of this patent is extended or adjusted under 35 U.S.C. 154(b) by 0 days.

(21) Appl. No.: 16/534,356

(22) Filed: Aug. 7, 2019

(51) Int. Cl.
*B25H 3/04* (2006.01)
*B25H 3/02* (2006.01)
*B25H 1/04* (2006.01)

(52) U.S. Cl.
CPC ..... *B25H 3/04* (2013.01); *B25H 1/04* (2013.01); *B25H 3/021* (2013.01)

(58) Field of Classification Search
CPC .. B25H 1/04; B25H 3/04; B25H 3/021; A47B 45/00; A47B 46/00
USPC ..... 312/205, 257.1, 231, 282, 196
See application file for complete search history.

(56) References Cited

U.S. PATENT DOCUMENTS 414,065 A * 10/1889 Luft
3,823,993 A * 7/1974 Kakishima ..... D05B 75/06 312/21
4,285,556 A * 8/1981 Loeffel ..... B25H 3/023 312/244
4,735,469 A * 4/1988 Liggett ..... A47B 81/06 108/6
5,951,129 A * 9/1999 Stein ..... B25H 3/00 206/373
5,988,779 A * 11/1999 Tu ..... H04N 1/10 312/291
6,578,938 B2 * 6/2003 Norman ..... A47B 43/00 206/373
6,786,162 B1 * 9/2004 Volkmer ..... A47B 5/06 108/115
6,811,232 B2 * 11/2004 Doan ..... B25H 3/028 312/291
7,715,681 B2 * 5/2010 Krampotich ..... G02B 6/4455 385/134
8,033,620 B2 * 10/2011 Retchloff ..... B25H 3/00 312/312

(Continued)

*Primary Examiner* — James O Hansen
(74) *Attorney, Agent, or Firm* — Innovation Capital Law Group, LLP; Vic Lin

(57) ABSTRACT

A workbench has a frame disposed on a set of wheels with a plurality of storage solutions, such as drawers, disposed within the frame. The workbench can include a work surface on a top surface of the frame and one or more handles permitting movement of the workbench as desired. The workbench can include a pegboard surface that is pivotable between a deployed configuration, where the pegboard extends upward from a back surface of the workbench, and a stowed configuration, where the pegboard is stored adjacent the back surface of the workbench. Typically, in the stowed configuration, the pegboard surface does not extend beyond either a plane defined by the work surface or a plane defined by a bottom surface, opposite the work surface, of the workbench frame. The workbench may be packaged and shipped in the stowed configuration, allowing the user to easily fully assembly the workbench assembly.

17 Claims, 4 Drawing Sheets

(56) References Cited

U.S. PATENT DOCUMENTS

| | | | | |
|---|---|---|---|---|
| D678,701 | S * | 3/2013 | Hansen | D6/561 |
| 10,113,574 | B1 * | 10/2018 | Bileth | F16B 2/12 |
| D840,715 | S * | 2/2019 | Lowenhielm | D6/553 |
| 2005/0062369 | A1 * | 3/2005 | Mizuno | A47B 21/00 312/196 |
| 2006/0145574 | A1 * | 7/2006 | Hung | B25H 3/00 312/249.11 |
| 2006/0266432 | A1 * | 11/2006 | Carter | B25H 1/02 144/286.1 |
| 2008/0304803 | A1 * | 12/2008 | Krampotich | E05B 65/46 385/135 |
| 2010/0026151 | A1 * | 2/2010 | Melkumyan | B62B 3/004 312/249.11 |
| 2012/0260833 | A1 * | 10/2012 | Taylor | A47C 9/06 108/69 |
| 2017/0360197 | A1 * | 12/2017 | Schooley, Jr. | A47B 88/483 |
| 2019/0264719 | A1 * | 8/2019 | Graben | A47B 31/00 |

* cited by examiner

WORKBENCH WITH COLLAPSIBLE PEGBOARD

BACKGROUND OF THE INVENTION

1. Field of the Invention

Embodiments of the invention relates generally to workbenches. More particularly, the invention relates to workbenches having a pivotable and collapsible pegboard panel attached thereto.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Workbenches typically include a frame having a top and a plurality of storage sections disposed therein. Such storage sections can include, for example, cabinets, drawers, shelves, or the like. Typically, the workbench frame is provided as a unitary member, where packaging and shipping container size is often defined at least by the size of the frame.

Some conventional workbenches may include additional features attached to the frame. Such additional features can significantly increase packaging and shipping container size or at least require the end user to perform significant assembly steps.

In view of the foregoing, there is a need for a workbench product that can include additional features without require the end user to perform substantial assembly steps and without requiring a large quantity of additional components that are separate from the workbench frame assembly.

SUMMARY OF THE INVENTION

Embodiments of the present invention provide a workbench comprising a workbench frame; a plurality of storage regions defined within the workbench frame; a pegboard attached to a back surface of the workbench frame, wherein the pegboard is pivotable between a first position, where the pegboard extends above a work surface of the workbench frame, and a second position, where the pegboard is positioned adjacent a back side of the workbench frame.

In some embodiments, the plurality of storage regions includes a plurality of drawers.

In some embodiments, the workbench further includes a work surface disposed on a top side of the workbench frame.

In some embodiments, the workbench further includes wheels removably attached to a bottom side of the workbench frame.

In some embodiments, the workbench further includes at least one handle removably attached to at least one of a left hand and a right hand side of the workbench frame.

In some embodiments, the pegboard includes one or more slots formed across a portion of a width thereof, wherein storage bins can be removably secured into the one or more slots.

Embodiments of the present invention further provide a workbench comprising a workbench frame; a plurality of drawers defined within the workbench frame; a pegboard; first and second brackets disposed on the back side of the workbench frame, the first and second brackets pivotally supporting the pegboard, wherein the pegboard is pivotable between a first position, where the pegboard extends above a work surface of the workbench frame, and a second position, where the pegboard is positioned adjacent a back side of the workbench frame; and the first and second brackets each include a pivot pin pivotally connecting the pegboard to the first and second brackets, at least one upper hole disposed above the pivot pin, at least one lower hole disposed below the pivot pin, wherein at least one bolt extends through the at least one lower hole and into the pegboard to secure the pegboard in the second position and the at least one bolt extends through the at least one upper hole and into the pegboard to secure the pegboard in the first position.

Embodiments of the present invention also provide a workbench comprising a workbench frame; a plurality of drawers defined within the workbench frame; a pegboard; first and second brackets disposed on the back side of the workbench frame, the first and second brackets pivotally supporting the pegboard; and at least one stopper disposed on at least one of the plurality of drawers, the at least one stopper movable between a first position, that permits the at least one of the plurality of drawers to move between open and closed positions, and a second position that prevents closure of the at least one of the plurality of drawers, wherein the pegboard is pivotable between a first position, where the pegboard extends above a work surface of the workbench frame, and a second position, where the pegboard is positioned adjacent a back side of the workbench frame.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
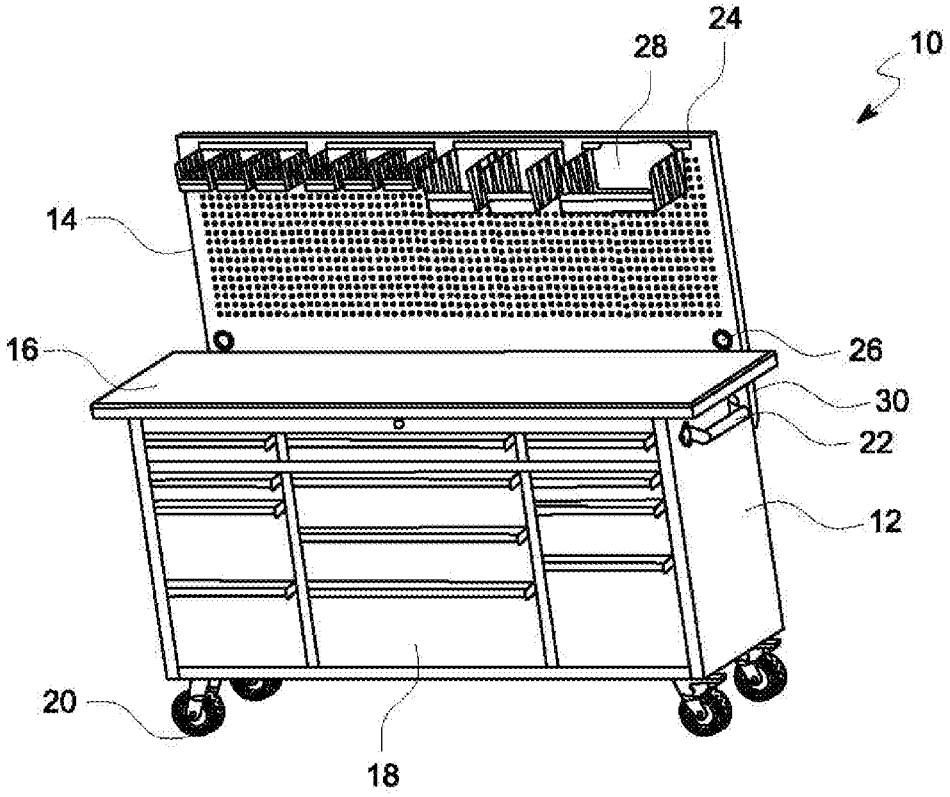
FIG. 1 illustrates a perspective view of a workbench assembly according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any system, and in particular, the embodiments of the present invention. A commercial implementation in accordance with the spirit and teachings of the present invention may be configured according to the needs of the particular application, whereby any aspect(s), feature (s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a workbench having a frame disposed on a set of wheels with a plurality of storage solutions, such as drawers, disposed within the frame. The workbench can include a work surface on a top surface of the frame and one or more handles permitting movement of the workbench as desired. The workbench can include a pegboard surface that is pivotable between a deployed configuration, where the pegboard extends upward from a back surface of the workbench, and a stowed configuration, where the pegboard is stored adjacent the back surface of the workbench. Typically, in the stowed configuration, the pegboard surface does not extend beyond either a plane defined by the work surface or a plane defined by a bottom surface, opposite the work surface, of the workbench frame.

The workbench may be packaged and shipped in the stowed configuration, allowing the user to easily fully assembly the workbench assembly. Such packaging may further reduce the overall volume needed to fully package the product, while limiting the time and labor required for assembly thereof.

Figure 2:
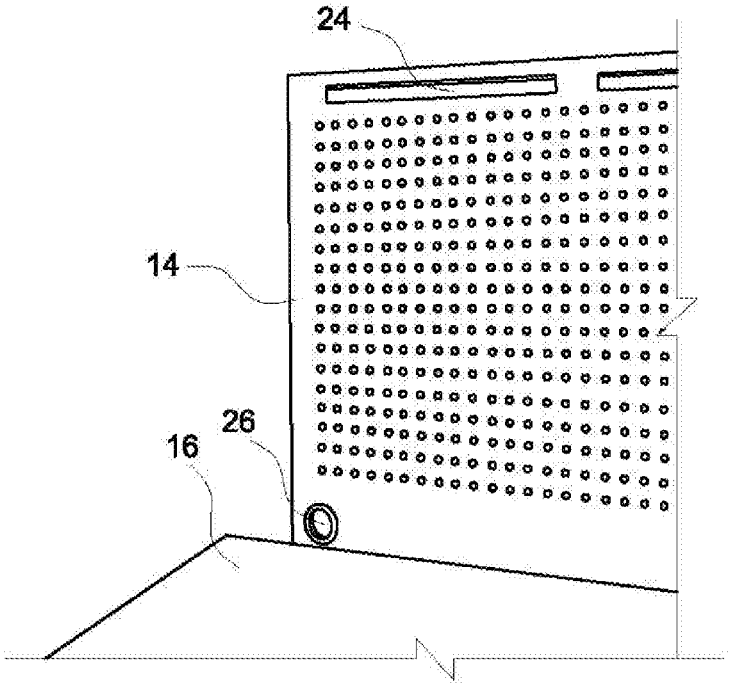
FIG. 2 illustrates a detailed perspective view of a workbench top and extending pegboard surface of the workbench assembly of FIG. 1.

Referring to FIGS. 1 and 2, a workbench assembly 10, also simply referred to as workbench 10, can include a workbench frame 12 that supports a plurality of storage solutions therein. The storage solutions can include drawers 18, shelves, cabinets, or the like. While a plurality of drawers 18 of particular sizes in a particular configuration are shown in FIG. 1, it should be understood that one or more drawers 18 may be substituted by an alternate storage solution. Further, the width or depths of the drawers 18 may be changed according to the needs of the end user. For example, two vertically disposed drawers may be replaced by a single drawer to provide a single drawer of increased depth.

The workbench assembly 10 can be disposed on wheels 20. The wheels may be removable from the frame 12 for shipping. For example, the wheels 20 may be disposed inside a drawer 18 to reduce packaging volume. The wheels 20 may be similar to those known in the art and may include pivoting wheels, wheels with a braking feature or the like. In some embodiments, at least one set of wheels (a set being define as the wheels on one of the left side or the right side of the workbench assembly 10) may be pivoting. Further, in some embodiments, at least one set of wheels may include a braking feature.

In this manner, the workbench assembly 10 may be easily moved about on a surface. To further assist in the movement of the workbench assembly 10, one or more handles 22 may be disposed on the frame 12. In some embodiments, one handle 22 may be disposed on each side of the frame 12, opposite each other. Like the wheels 20, the handles 22 may be removable from the frame 12 and, for example, stored in a drawer 18, to reduce packaging volume.

A work surface 16 may be disposed on a top of the frame 12. The work surface 16 may be affixed to the frame and, in some embodiments, may be removable therefrom. In some embodiments, the work surface 16 may be the top of the frame 12, where no additional structural element is disposed thereupon. In many embodiments, the work surface 16 may be a solid structural member disposed on the top of the frame 12. For example, the work surface 16 may be formed from wood, such as a hardwood including rubber wood, as one example.

A pegboard sheet 14, also referred to simply as pegboard 14, may be attached to the back of the frame 12. The pegboard 14 can include one or more large holes 26 formed there through, where such holes 26 may be suitable for routing wires, or the like. In additional to standard pegboard holes, the pegboard 14 can also include one or more slots 24 cut therein. The slots 24 may provide an attachment region for other storage components, such as storage bins 28. The storage bins 28, for example, may include a curved back member that can fit into the slot and slide downward onto the pegboard 14, thus supporting the storage bins 28 to the pegboard 14. Of course, other attachment mechanisms may be used to secure the bins 38 to the pegboard 14.

Figure 3:
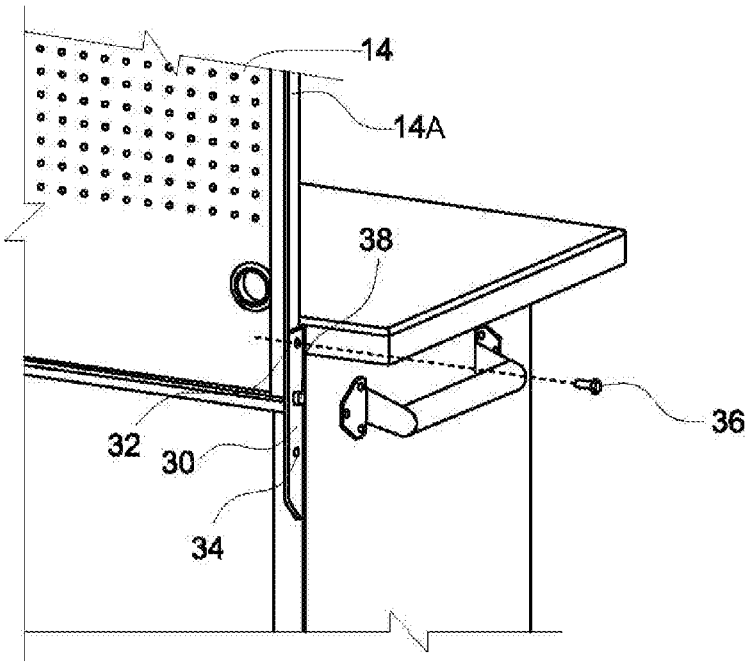
FIG. 3 illustrates a detailed side perspective view of the workbench assembly of FIG. 1, showing insertion of a bolt to secure the pegboard surface in an upright, deployed configuration.
Figure 4:
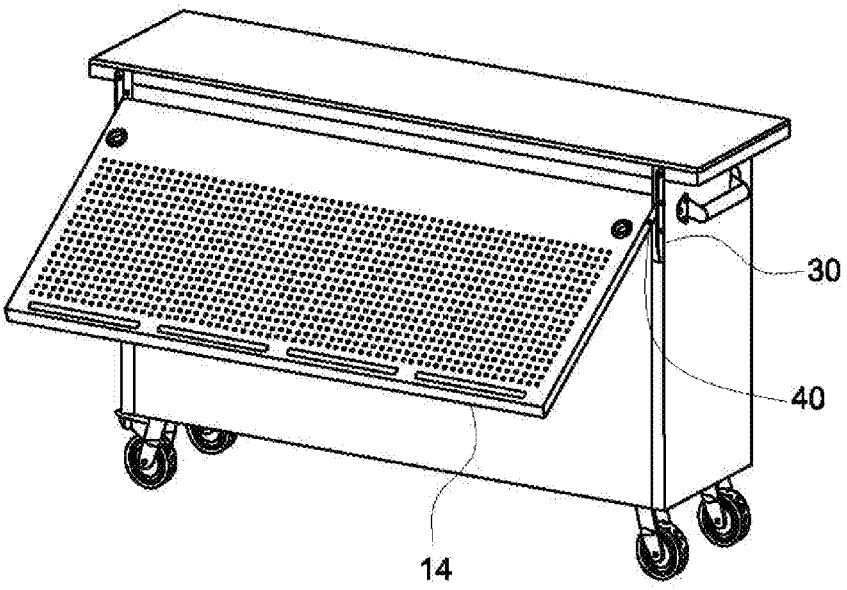
FIG. 4 illustrates a detailed side perspective view of the workbench assembly of FIG. 1, showing a transition state of the pegboard surface between the upright, deployed configuration of FIG. 3, and the stored configuration of FIG. 5.
Figure 5:
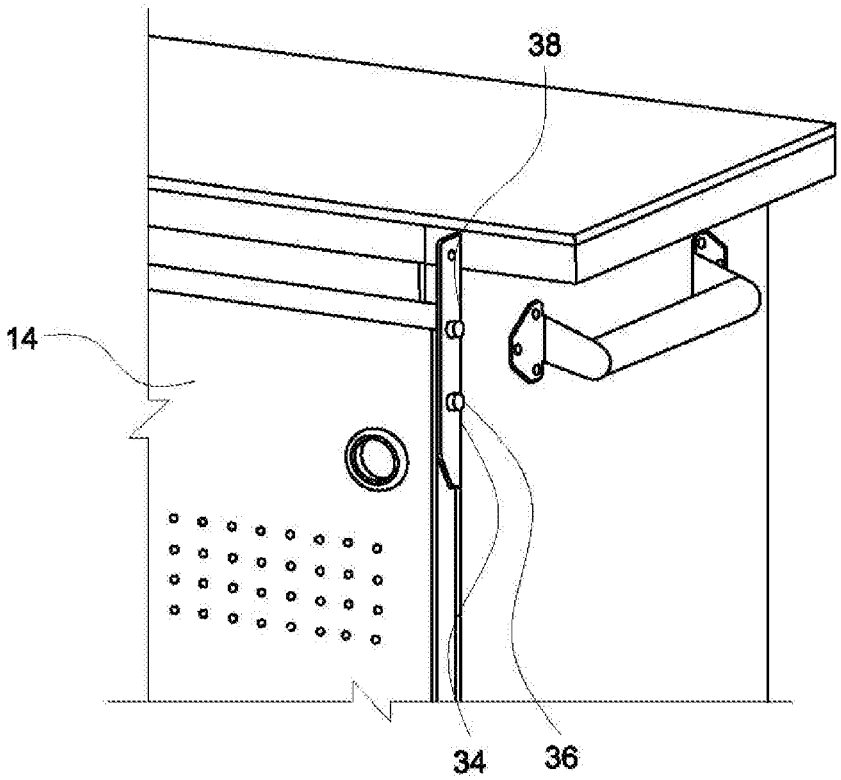
FIG. 5 illustrates a detailed side perspective view of the workbench assembly of FIG. 1, showing the pegboard surface in a stored configuration.

Referring to FIGS. 3 through 5, the workbench assembly 10 can permit the pegboard 14 to move between a deployed configuration, as shown in FIGS. 1, 2 and 3, for example, and a stowed configuration, as shown in FIG. 5. In the deployed configuration, the pegboard 14 may extend above a plane defined by the work surface 16. Typically, as discussed below, the height of the pegboard 14 above the work surface 16 will be less than a height of the frame 12.

The pegboard 14 can be attached to a bracket 30 disposed on each side of a back portion of the frame 12. The bracket can include at least one upper hole 32 and at least one lower hole 34. A pivot connection 38 may be located between the upper hole 32 and the lower hole 34, where the pivot connection 38 can pivotally attach the pegboard 14 to the bracket 30.

When the workbench assembly 10 is shipped to a user, it may be in the stowed configuration (FIG. 5) to minimize packaging volume. A bolt 36 may be disposed through the lower hole 34 and into the side of the pegboard 14 (or a frame member 14A that surrounds the pegboard 14, for example) to retain the pegboard 14 in the stowed configuration. To assemble the workbench assembly 10, the user can simply remove the bolt 36 from the lower holes 34 on each of the brackets 30, pivot the pegboard, as shown in FIG. 4, into the deployed configuration, and insert the bolt 36 through the upper hole 32 and into the side of the pegboard 14. Typically, the frame member 14A of the pegboard will include one or more holes 40 that engage with the bolt 36 when passes through the lower hole 34 in the stowed configuration and when the bolt 36 passes through the upper hole 32 in the deployed configuration.

In some embodiments, the side of the pegboard 14, or a frame member 14A disposed about the pegboard 14, may include a female threaded hole 40 configured to mate with the threads of the bolt 36. In this exemplary embodiment, the user only has one component (the bolt 36) on each side of the frame 12, to secure to move the pegboard 14 into the deployed configuration.

As described above, in some embodiments, the pegboard 14 has a height that is less than the height of the frame 12 of the workbench assembly 10. By being configured in this manner, when the pegboard 14 is in the stowed position, the pegboard 14 may be disposed entirely adjacent a back surface of the frame 12, without extending above a plane defined by the work surface 16 or below a plane defined by the bottom of the frame 12. Thus, when in the stowed configuration, the packaging volume is only minimally increased due to the presence of the pegboard 14 being adjacent the back surface of the frame.

Figure 6:
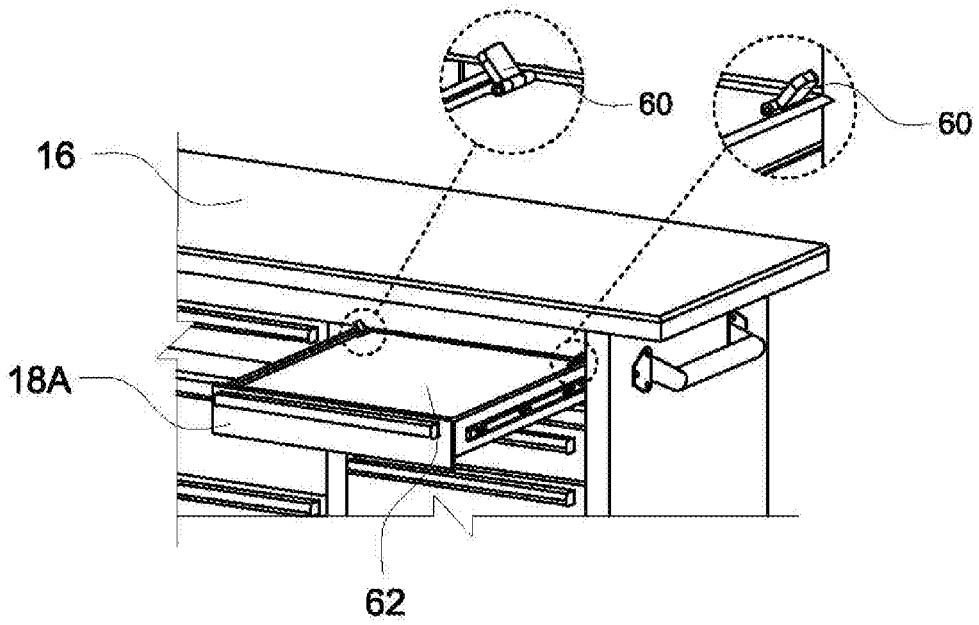
FIG. 6 illustrates a detailed view of a drawer, having a work surface disposed therein, in an extended configuration with stoppers deployed to lock the drawer in the extended configuration.
Figure 7:
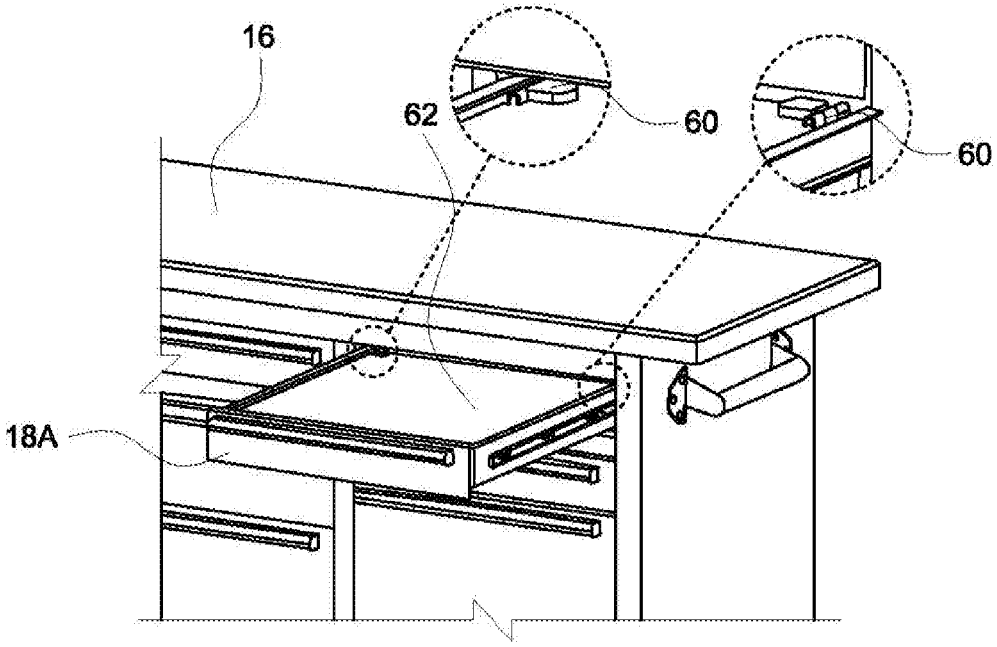
FIG. 7 illustrates a detailed view of the drawer of FIG. 6, showing the stoppers in a drawer-use configuration, permitting the drawer to be freely opened and closed.

Referring now to FIGS. 6 and 7, in some embodiments, one or more of the drawers 18, such as drawer 18A, may include a stopper 60 that may be moved into a locked configuration (as shown in FIG. 6), where the opened drawer 18A may be prevented from being closed. In some embodiments, the stopper 60 may be disposed on either side of the drawer 18A such that, when moved into the locked configuration, the stoppers 60 are adjacent the frame 12, thereby preventing closure of the drawer 18A. In the unlocked configuration, as shown in FIG. 7, the stoppers 60 may be disposed inside the drawer 18A, permitting opening and closure thereof.

In some embodiments, a drawer filler 62 may be disposed inside the drawer to provide a work surface thereupon. When a user of the workbench assembly 10 desires additional workspace, they can open the drawer 18A and use surface provided by the drawer filler 62 as additional workspace. With the stoppers 60 in the locked configuration, the drawer 18A is prevented from closing, thereby providing a safe, non-movable, additional workspace.

In some embodiments, the drawer filler 62 may be configured to be removable disposed in the drawer 18A. Typically, the height of the drawer filler 62 may be nearly flush with the sides of the drawer 18A. The drawer filler 62 may be removed from the drawer 18A to provide a standard drawer storage solution. While the figures show one drawer having the drawer filler 62, such a design, including the stoppers 60, may be utilized on any of the drawers 18 of the workbench assembly 10.

The workbench assembly 10 may be made from materials known in the art and suitable for the purposes as described herein. In some embodiments, metal components of the workbench assembly may be formed from stainless steel, for example.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A workbench comprising:

a workbench frame;

a plurality of storage regions defined within the workbench frame;

a pegboard attached to a back surface of the workbench frame; and first and second brackets disposed on the back side of the workbench frame, the first and second brackets pivotally supporting the pegboard wherein the first and second brackets each include:

a pivot pin pivotally connecting the pegboard to the first and second brackets;

at least one upper hole disposed above the pivot pin; and at least one lower hole disposed below the pivot pin, wherein at least one bolt extends through the at least one lower hole and into the pegboard to secure the pegboard in the second position; and the at least one bolt extends through the at least one upper hole and into the pegboard to secure the pegboard in the first position, wherein the pegboard is pivotable between a first position, where the pegboard extends above a work surface of the workbench frame, and a second position, where the pegboard is positioned adjacent a back side of the workbench frame.

2. The workbench of claim 1, wherein the plurality of storage regions includes a plurality of drawers.

3. The workbench of claim 2, further comprising at least one stopper disposed on at least one of the plurality of drawers, the at least one stopper movable between a first position, that permits the at least one of the plurality of drawers to move between open and closed positions, and a second position that prevents closure of the at least one of the plurality of drawers.

4. The workbench of claim 3, further comprising a drawer insert fitting inside the at least one of the plurality of drawers, the drawer insert providing a supplemental work surface for a user.

5. The workbench of claim 3, wherein the at least one of the plurality of drawers is at least one of an uppermost set of the plurality of drawers.

6. The workbench of claim 1, wherein the work surface is disposed on a top side of the workbench frame.

7. The workbench of claim 1, further comprising wheels removably attached to a bottom side of the workbench frame.

8. The workbench of claim 1, further comprising at least one handle removably attached to at least one of a left hand and a right hand side of the workbench frame.

9. The workbench of claim 1, wherein:

the pegboard includes at least one female threaded hole on each side thereof;

the at least one female threaded hole aligning with the at least one upper hole when the pegboard is in the first position; and the at least one female threaded hole aligning with the at least one lower hole when the pegboard is in the second position.

10. The workbench of claim 1, wherein the pegboard includes one or more slots formed across a portion of a width thereof.

11. The workbench of claim 10, further comprising one or more bins removably securable into the one or more slots.

12. A workbench comprising:

a workbench frame;

a plurality of drawers defined within the workbench frame;

a pegboard;

first and second brackets disposed on the back side of the workbench frame, the first and second brackets pivotally supporting the pegboard, wherein the pegboard is pivotable between a first position, where the pegboard extends above a work surface of the workbench frame, and a second position, where the pegboard is positioned adjacent a back side of the workbench frame; and the first and second brackets each include:

a pivot pin pivotally connecting the pegboard to the first and second brackets;

at least one upper hole disposed above the pivot pin; and at least one lower hole disposed below the pivot pin, wherein at least one bolt extends through the at least one lower hole and into the pegboard to secure the pegboard in the second position; and the at least one bolt extends through the at least one upper hole and into the pegboard to secure the pegboard in the first position.

13. The workbench of claim 12, wherein the work surface is disposed on a top side of the workbench frame.

14. The workbench of claim 12, further comprising:

wheels removably attached to a bottom side of the workbench frame; and at least one handle removably attached to at least one of a left hand and a right hand side of the workbench frame.

15. The workbench of claim 12, further comprising at least one stopper disposed on at least one of the plurality of drawers, the at least one stopper movable between a first position, that permits the at least one of the plurality of drawers to move between open and closed positions, and a second position that prevents closure of the at least one of the plurality of drawers.

16. A workbench comprising:

a workbench frame;

a plurality of drawers defined within the workbench frame;

a pegboard;

first and second brackets disposed on the back side of the workbench frame, the first and second brackets pivotally supporting the pegboard, wherein the first and second brackets each include:

a pivot pin pivotally connecting the pegboard to the first and second brackets;

at least one upper hole disposed above the pivot pin; and at least one lower hole disposed below the pivot pin, wherein at least one bolt extends through the at least one lower hole and into the pegboard to secure the pegboard in the second position; and the at least one bolt extends through the at least one upper hole and into the pegboard to secure the pegboard in the first position; and at least one stopper disposed on at least one of the plurality of drawers, the at least one stopper movable between a first position, that permits the at least one of the plurality of drawers to move between open and closed positions, and a second position that prevents closure of the at least one of the plurality of drawers, wherein the pegboard is pivotable between a first position, where the pegboard extends above a work surface of the workbench frame, and a second position, where the pegboard is positioned adjacent a back side of the workbench frame.

17. The workbench of claim 16, further comprising a drawer insert fitting inside the at least one of the plurality of drawers, the drawer insert providing a supplemental work surface for a user.

* * * * *